United States Patent [19]

Taylor

[11] 4,232,894

[45] Nov. 11, 1980

[54] SELECTIVELY RELEASABLE OVERSHOT AND PULL TOOL

[76] Inventor: William T. Taylor, P.O. Box 309, Warren, Tex. 77664

[21] Appl. No.: 62,912

[22] Filed: Aug. 2, 1979

[51] Int. Cl.[3] ..... E21B 31/12

[52] U.S. Cl. ..... 294/86.21; 294/86.25; 294/86.3

[58] Field of Search ..... 294/86.1, 86.3–86.33, 294/94–96, 110 R, 110 B; 166/99, 125, 137; 175/315; 285/360; 403/13

[56] References Cited

U.S. PATENT DOCUMENTS

| | | | |
|---|---|---|---|
| 2,250,463 | 7/1941 | Boynton | 403/13 |
| 2,893,491 | 7/1959 | Crowe | 175/315 |
| 3,211,479 | 10/1965 | Brown | 285/360 |
| 4,061,389 | 12/1977 | Keller et al. | 294/86.3 |
| 4,093,294 | 6/1978 | Taylor | 294/86.25 |
| 4,101,157 | 7/1978 | Richey | 294/86.21 |

*Primary Examiner*—Johnny D. Cherry
*Attorney, Agent, or Firm*—Guy E. Matthews

[57] ABSTRACT

A pulling tool for retrieving an article or fish from a well bore and utilizing a spear or grapping type action to establish connection with the fish. Cooperative internal and external tubular members are selectively movable to secure the pulling tool to the fish or to release the fish. An internal spring element cooperating with a positioning pin establishes controlled relative movement of the internal and external tubular members upon simple linear movement of the tool.

18 Claims, 7 Drawing Figures

SELECTIVELY RELEASABLE OVERSHOT AND PULL TOOL

FIELD OF THE INVENTION

This invention relates generally to down hole tools for conducting mechanical activities in wells and, more specifically, relates to a simply and efficiently operable mechanism for installing and removing objects in wells, including objects that might be stuck or lost within a well bore.

BACKGROUND OF THE INVENTION

The subject matter hereof is related to the subject matter of U.S. Pat. No. 4,061,389 and is directed specifically to the improvement that promotes effective connection of a pull tool to a down hole object or fish and simple and effective disconnection of the pull tool from the article if such is desired.

During drilling operations, well servicing operations and the like, objects may become lost or stuck within a well bore and these objects are typically referred to in the industry as "fish." For example, a section of drill pipe or production tubing might become disconnected from a pipe string and it is then necessary to introduce a pull tool into the well bore, establish connection with the fish and then remove the fish. Many different types of pull tools, grap pling devices, spears, etc. have been developed for the purpose of conducting fishing operations in well bores. It is typical for wire line operations to be utilized for the purpose of introducing a pull tool into the well bore for fishing operations.

In many cases, down hole devices are positioned within casing and tubing strings for the purpose of controlling well operations. In most cases, such down hole devices are equipped with API Standard fishing necks which normally include an undercut shoulder to enable grappling by standard installation and retrieval tools. Quite often the API Standard fishing neck will become corroded or eroded by well conditions to the point that only a stub pipe is exposed without the usual undercut shoulder that is provided on the fishing neck. Connection between a wire line controlled fishing tool and a worn fishing neck may be accomplished by means of an overshot type grappling device generally defined by a collet structure having internal teeth that establish a gripping relation with the worn fishing neck. Although overshot type retrieving tools are successfully utilized in many cases, a common problem with such tools is the inability of the operator to achieve disconnection from the worn fishing neck in the event the tool is unable to accomplish an effective pulling operation. Occasionally, disconnection can be achieved by a substantial jarring or other violent mechanical movement, but, in some cases, disconnection of the pulling tool from the fish is extremely difficult if not impossible. In cases where the pulling tool or wire line is inadequate for the pulling operations that are required, it is necessary that the pulling tool be disconnected from the fish and replaced with a wire line controlled pulling tool of substantially greater pulling capacity. If a light-weight wire line pulling tool is unable to accomplish the pulling operation and becomes firmly fixed to the fish or other object to be pulled, retrieval of the fishing equipment itself obviously compounds the problem and adds materially to the expense of the service operation.

As mentioned above, application of shocks to the pulling tool will sometimes result in disconnection, thereby enabling service personnel to remove the wire line pulling tool and substitute a tool and wire line of substantially heavier gauge. Application of mechanical shocks to the down hole equipment of the well and the wire line tool itself can easily cause failure or excessive wear of one or more of these mechanical components. It is desirable, therefore, to provide down hole service equipment, such as wire line controlled pulling tools, that will effectively become interconnected with down hole objects such as wire line tools, fish, etc., and, in the event disconnection is necessary, will readily become disconnected upon simple mechanical movement of a wire line controlled pulling tool.

SUMMARY OF THE INVENTION

The present invention may effectively take the form of an external pull tool or overshot that is adapted for use in well servicing operations or an internal pull tool or spear, depending upon the particular service operation that is involved. Although not restricted particularly to wire line service operations, the invention is effectively adapted to be provided on a wire line controlled pulling tool and run into the well casing or well bore for the purpose of establishing a mechanical connection with an object positioned in the well bore and applying sufficient force thereto to remove the object from the well. Whether the pulling tool takes the form of an external overshot or an internal spear, in each case, the tool structure takes the form of an outer tubular body having an inner body structure disposed in movable relation therein. Telescoping movement of the inner and outer body structures of the tool causes the overshot or spear to selectively move into gripping relationship with the object that is to be removed from the well bore. The tubular outer body is secured about the inner body by means of a catch mechanism having a locking position and an unlocking position, depending upon the relative positions of the inner and outer body structures. A pin structure forming a part of the catch mechanism is selectively positioned within pin receiving grooves and a control spring is employed to ensure that the pin alternately enters one or the other of a pair of unlocking or locking grooves each time the inner and outer body structures are cycled linearly relative to one another. If the tool is locked in relation to the fish or other object positioned in the well bore, unlocking may be achieved simply by downward movement of the control line tool followed by subsequent upward movement thereof. Further, in the event the pulling tool is unlocked with respect to the down hole object, locking may be achieved simply by downward movement of the pulling tool, followed by subsequent upward movement thereof.

DESCRIPTION OF THE PREFERRED EMBODIMENT

Figure 1:
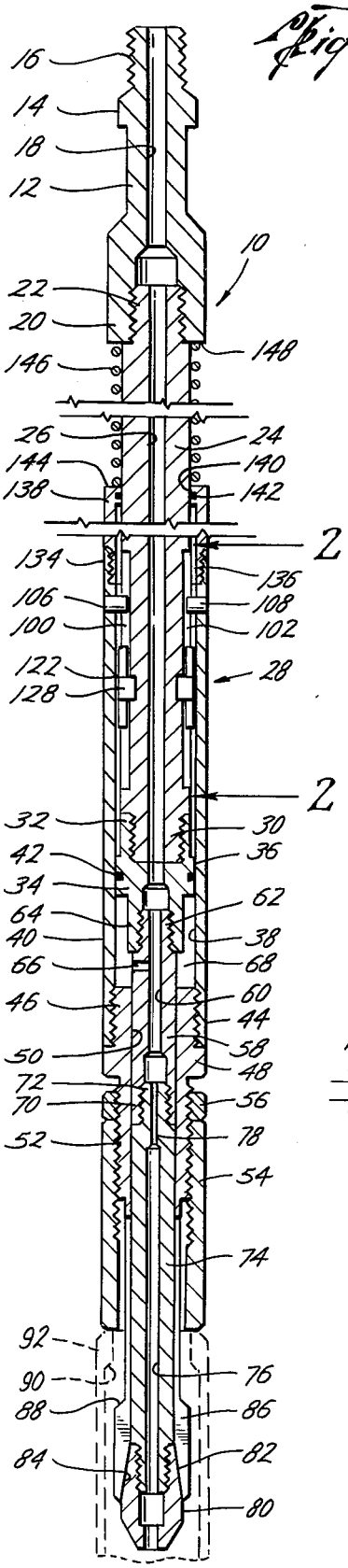
FIG. 1 is an axial sectional view of a mechanism for installation and retrieval of down hole objects, which mechanism is constructed in accordance with the teachings of the present invention and is provided with an expandable collet type device for establishing internal connection with an object to be pulled from the well bore.

Referring now to the drawings and first to FIG. 1, there is shown an object removal tool generally at 10 having a upper sub 12 that is formed to define a fishing neck 14 and upper external threads 16 so as to enable the tool to be run into the well by suitable wire line equipment that establishes a threaded connection with external threads 16 of the upper sub. In the event the wire line equipment should become inadvertently separated from the upper sub 12, a wire line controlled fishing tool may simply be run into the well and will establish a suitable interconnection with the fishing neck structure 14. The upper sub 12 is also formed to define an internal bore or fluid passage 18 and a lower internally threaded extremity 20 that establishes threaded connection with an externally threaded upper portion 22 of an inner body element 24 that is also formed to define an internal bore or fluid passage 26. The intermediate portion of the inner body 24 is formed to define a portion of a locking mandrel illustrated generally at 28 and which will be described in detail hereinbelow. The inner body structure 24 is formed to define an externally threaded lower portion 30 that is adapted to receive the internally threaded portion 32 of a piston and guide element 34 having an outer cylindrical surface 36 that is adapted to be disposed in close fitting, sliding relationship with an internal cylindrical surface 38 defined by an outer body structure or housing 40. The piston and guide element 34 is also formed to define an external seal groove within which is received an annular sealing element 42, such as an O-ring or the like, that establishes a sealed relationship with the inner cylindrical surface 38 of the housing structure 40. The piston and guide portion functions to establish proper positioning relative to the inner and outer body structures 24 and 40 during all phases of relative movement therebetween. The lower portion of the outer housing structure is formed to define an internally threaded portion 44 that is adapted to receive an externally threaded portion 46 of a body closure element 48 that is also formed to define a cylindrical internal bore 50 and an externally threaded tool adjustment portion 52. An adjusting spacer element 54 is threadedly received by the elongated externally threaded adjustment portion 52 of the closure element 48 and may be locked in place relative to the adjustment portion 52 by means of a locking ring 56. By adjusting the position of the adjustment spacer 54 relative to the adjustment portion 52 of the closure element, a connection device such as a spear slip or collet may be accurately positioned with respect to internal locking structure of various locking mandrels, pipes, etc.

Figure 1A:
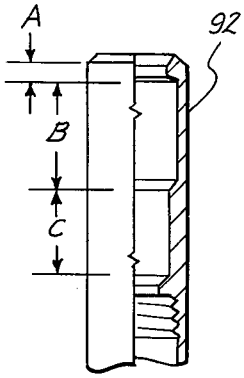
FIG. 1*a* is a partial sectional view of an object that is positioned within a well and illustrating the various surfaces thereof that are engageable by a pulling tool according to the present invention.

As illustrated in FIG. 1, a tool connector sub 58 having an internal fluid passage 60 formed therein, is also formed to define an externally threaded connector portion 62 that is adapted to be received by an internally threaded portion 64 of the piston and guide element 34. The tool connector sub 58 is also formed to define a transverse passage or port 66 that establishes communication between the passage 60 of the connector sub and an annulus or chamber 68. The lower extremity of the tool connector sub 58 is formed to define an internally threaded portion 70 that is adapted to receive an externally threaded connector portion 72 of a tool support sub 74 that is formed to define an internal passage 76 that is in communication with a restricted internal passage 78 defined at the upper extremity of the tool support sub. A nose cone element is threadedly connected to the lower extremity of the tool support sub 74 and defines a frusto-conical cam surface 82 that reacts with internal cam surfaces 84 defined on a plurality of collet elements 86 that are integral or interconnected to the lower portion of the threaded adjustment portion 52 of the closure element 48. As the nose cone element 80 is moved upwardly relative to the collet elements 86, the cam surfaces react thereby forcing the collet elements outwardly in order that collet shoulder surfaces 88 will engage internal support surfaces 90 defined within the object 92 to be removed from the well bore. The collet elements 86 are properly positioned relative to the internal shoulder 90 of the objects 92 when the lower extremity of the adjustable spacer element 54 is brought into contact with the object. Accurate positioning may be accomplished simply by adjusting the position of the adjustable spacer element relative to the threaded adjustment portion 52 of the closure element 48. With reference to FIG. 1*a*, the various dimensions referred to as A, B and C may be adjusted for by means of the adjustment spacer 54. If dimension B is distorted, such as by erosion, corrosion, etc., the adjustment spacer may be positioned in such manne as to cause the spear slip structure to engage dimension A, thereby establishing a firm interconnection between the pulling tool and the object 92. If dimension A is distorted, a fishing operation may be accomplished by adjusting the spacer element 54 in order that the collet structure illustrated in FIG. 1 or the slip structure illustrated in FIG. 3 may be utilized to establish a firm connection with dimension B defined by the object 92. In the event dimensions A and B are both distorted, then the adjustable spacer element 54 may be positioned in such manner as to cause the spear slip structure shown in FIG. 3 to establish firm engagement with dimension C. In this case, the spear slip structure illustrated in FIG. 3 takes the general form of the collet structure illustrated in FIG. 1 with the exception that slip elements 94 are formed at the lower extremities of the yieldable fingers 96 and slip teeth 98 are defined for the purpose of establishing a firm gripping relationship with the cylindrical surfaces defined at B or C in FIG. 1*a*.

It is desirable to provide means for controlling, locking and unlocking of the collet or spear slip structures illustrated in FIG. 1 with respect to the object 92 illustrated in FIG. 1*a*. In order to facilitate locking and unlocking, the pulling tool structure is provided with a controllable locking mechanism illustrated at the central portion of FIG. 1 and shown in detail in FIG. 2. The inner body structure 24 is formed to define a plurality of locking or latching recesses, three of which are illustrated in broken lines at 100 and 102, and one recess being shown in full line at 104. Each of the locking or latching recesses is of substantially identical configuration and function together with other structure to provide controlled guiding or tracking movement for guide pins that are associated respectively with each of the recesses. As shown in FIG. 1, a pair of guide pins 106 and 108, each being retained by the outer housing structure 40, are associated respectively with latching recesses 100 and 102 while in FIG. 2, guide pin 110 is associated with latching recess 104. In the case of the pulling tool illustrated in FIG. 1, the latching mechanism incorporates four substantially identical latching recesses and guide pins being received respectively therein. It should be borne in mind, however, that the particular number of latching recesses and guide pins is not in any way restrictive as regards the present invention. In some cases, only two latching recesses and guide pins may be employed to control latching and unlatching of the pulling tool mechanism.

Figure 2:
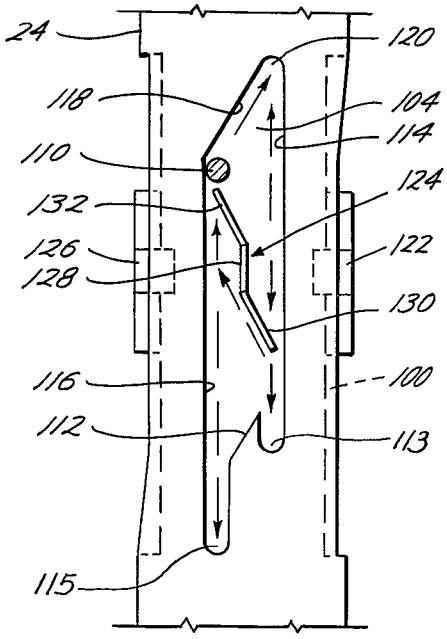
FIG. 2 is a fragmentary elevational view of the internal body structure of the tool taken along line 2—2 of FIG. 1 and illustrating a portion of the catch mechanism thereof in detail.

As illustrated in FIG. 2, each of the latching recesses takes the form shown defining a pair of lower pin receiving slots, grooves or receptacles 113 and 115 that are each adapted to receive the guide pin 110 and inclined cam surface 112 is defined between slots. A pair of parallel guide surfaces 114 and 116 are also defined by the recess and a upper inclined cam surface 118 extends from surface 116 to a upper pin receiving receptacle 120 that is also adapted to receive the guide pin 110 depending upon particular vertical positioning of the inner and outer body structures.

It should be pointed out that pin receiving slot 113 comprises an unlatching slot while pin receiving slot 115 defines a latching slot. When the pin member 110 is received within the unlatching slot 113 as shown in FIG. 2, the inner body structure 24 and the nose cone 80 will be moved upwardly relative to the outer body or housing portion 40 and the collet elements 86 or spear slip elements 94 will be positioned at the unexpanded or inner positions thereof and will not be capable of establishing interlocking engagement with the object to be removed from the well bore. When the pin member 110 is received within the latching slot 115, the inner body structure 24 will be positioned upwardly relative to the outer housing structure 40, thus causing the nose cone element 80 to cam the collet elements 86 or spear slip elements 94 outwardly into engaging and locking relation with the object.

In order to control selective positioning of the guide pin member 110 relative to the latching or unlatching slots, relative rotation of the inner and outer body portions of the pulling mechanism must occur. By providing appropriate guide surfaces within the recess structure, the guide pin will engage these guide surfaces and will accomplish relative rotational positioning of the inner and outer body portions. Inclined cam surfaces 112 and 118 will obviously induce transverse movement of the guide pin 110 when the pin is in engagement with these cam surfaces and the inner and outer body structures are caused to move axially one relative to the other. It is desirable to provide means for ensuring alternate latching and unlatching of the pulling tool mechanism in order that the operating personnel thereof may ensure appropriate selective control of the pulling tool mechanism to accomplish desired results. It is desirable, therefore, to provide a closed circuit feature by means of appropriate cam surfaces and ensure that the pin is capable of moving only within the restrictions of the closed circuit and thus enabling operating personnel to provide efficient selective control. In accordance with the present invention, a plurality of spring elements are provided as shown at 122, 124 and 126. Each of these spring elements is substantially identical and, as illustrated generally at 124, the spring elements incorporate an intermediate support portion 128 that is interconnected with the inner body structure by any suitable means of connection. The spring element is formed to define a pair of opposite disposed camming elements 130 and 132 that are interconnected with the intermediate portion 128 and are free for movement within the recess 104. As the outer body or housing moves downwardly relative to the inner body, guide pin 110 is moved downwardly and engages the inclined spring portion 132. The free extremity of the spring is thus forced into engagement with the surface 116 and therefore prohibits further axial movement of the pin 110 unless there is relative rotation between the inner and outer body structures. As the pin 110 moves downwardly within the recess 104, the inclined spring portion 132 causes rotation of the pin and thus relative rotation of the inner and outer body structures until the pin reaches the level of the intermediate axially oriented portion 128. After the pin has been so oriented with respect to the spring element 124, further downward movement of the pin causes the pin to contact the lower inclined spring portion 130. At this point, it should be noted that the pin 110 will be oriented above the tapered cam surface 112 or the unlatching receptacle or groove 113. If the pin is caused to move downwardly from this point, it will move directly into the unlatching receptacle 113 or first engage the cam surface 112 and will then be cammed into the latching receptacle 115. The pulling tool mechanism, therefore, may be unlatched simply by causing limited axial movement of the inner and outer housings and then causing relative movement of the inner and outer housings in the opposite direction. When it is again desired to cause the pulling tool mechanism to be moved to the latching position thereof, the guide pin 110 is moved upwardly from the latching receptacle 115 or from any position therebelow and is caused to move into forcible engagement with the inclined spring portion 132. Further upward movement of the guide pin 110 causes the inclined portion 132 of the spring to yield, thereby allowing the guide pin 110 to enter the upper portion of the recess 104 where it engages the inclined cam surface 118 thus causing relative rotation of the inner and outer body structures until the pin has moved into contact with the upper pin receptacle 120. After this has been accomplished, downward movement of the pin 110 relative to the recess 104 will cause the pin to move into engagement with the spring element 124. If slight rotational movements occurred as the pin is being moved upwardly, the pin may contact the inclined upper portion 132 of the spring 124. If this occurs, the upper portion of the spring will yield into engagement with the side surface 116 of the recess and will cause the pin to be cammed toward side surface 114, thus causing relative rotation of the inner and outer body structures. Further axial movement of the pin relative to the recess 104 will cause the pin to engage the lower inclined portion 130 of the spring element thus causing the lower portion of the spring element to yield inwardly to the extent necessary to allow the pin 110 to pass. In this condition, the pin 110 will be oriented properly with respect to the unlatching slot or receptacle 113 and it will move directly into the unlatching slot, thus locking the inner and outer body portions of the pulling tool mechanism against further relative rotation. The collet structures 86 or the slip structures 94 will therefore be disconnected from the object in this particular condition and the pulling tool may be removed from the well bore, if desired. Also, if desired, the pulling tool may be caused to move into subsequent latching engagement with the object within the well bore without necessitating removal and recocking of the latching mechanism. Latching and unlatching of the pulling tool from the object may occur any suitable number of times within the discretion of the operating personnel in charge of the tool pulling or fishing operation. There is no necessity to cause jarring or mechanical vibration of the fishing tool in order to accomplish removal of the object from the well or in order to accomplish release of the object from the pulling tool in the event the pulling tool is found insufficient to accomplish the pulling operation.

The upper portion of the outer housing structure is defined by an internally threaded portion 134 that is adapted for threaded connection to an externally threaded portion 136 of an upper closure or cap structure 138 that defines an aperture 140 through which the inner body structure 24 extends. An annular sealing element 142 as an O-ring or the like retained within an appropriae seal groove establishes a sealed relationship between the inner body structure 24 and the closure portion 138 of the outer housing. The upper portion of the closure element 138 is formed to define a shoulder surface 144 against which the lower portion of a compression spring element 146 is seated. The upper portion of the spring element is received in engagement with an abutment surface 148 defined by the upper sub element 12. The compression spring element 146 functions to maintain the inner body portion 24 of the mechanism in an upward position relative to the outer housing 40 and, in the free condition thereof, causes the guide pin element 110 to be positioned at one of the lower receptacles 113 and 115. The guide pin is caused to move upwardly within the recess 104 when the adjustable spacer element 54 is moved into engagement with the upper extremity of the object, thus causing the collet or spear to be inserted into the object and positioned for engagement with an appropriate surface or structural formation therein. Further downward movement of the inner body element 24 relative to the outer body structure results in downward movement of the guide pin 110 relative to the recess structure 104 thus positioning the guide pin 110 within respective ones of the unlatching or latching slots 113 and 115. Downward movement of the outer housing structure 40 relative to the inner body structure 24 is induced by the compression spring 146 when the tool mechanism is moved upwardly and the force against the lower portion of the outer housing is relieved by such upward movement.

Figure 3:
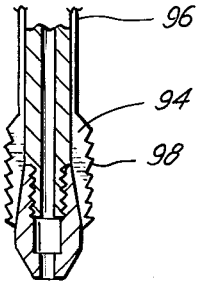
FIG. 3 is a partial elevational view of an external grapple device that may be substituted for the collet structure shown at the lower extremity of FIG. 1 and incorporating external teeth for internally gripping an object such as drill pipe or tubing.
Figure 4:
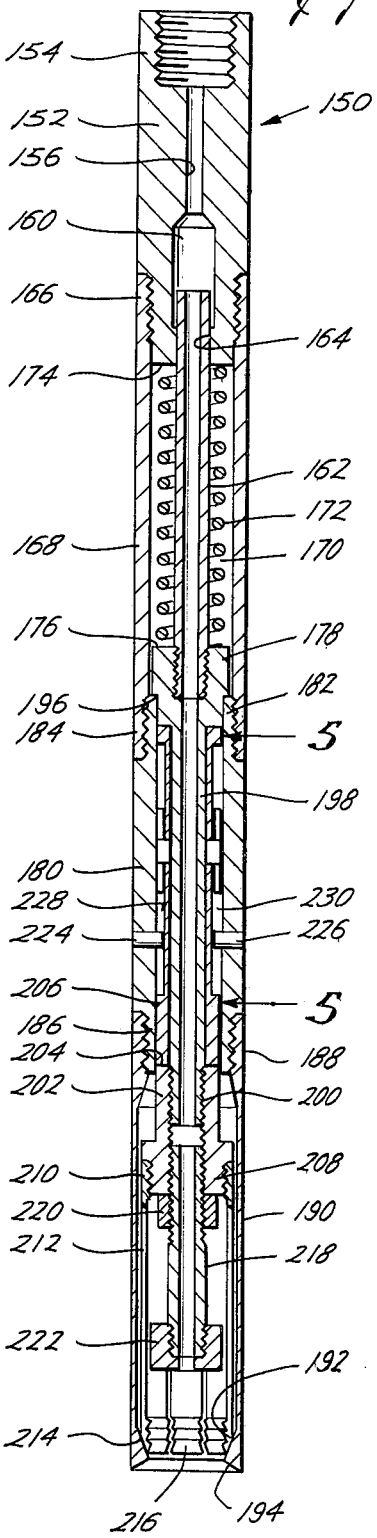
FIG. 4 is an axial sectional view of a mechanism for installation and retrieval of down hole objects in a well which mechanism represents an alternative embodiment of the present invention adapted for overshot type grappling and removal of objects from well bores.
Figure 5:
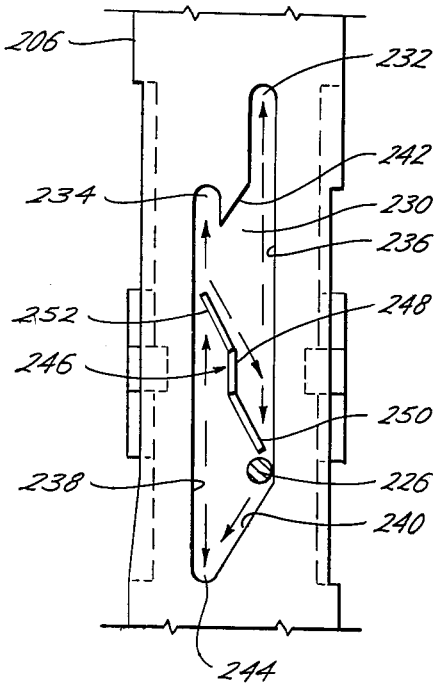
FIG. 5 is a fragmentary elevational view of the inner body structure of the mechanism of FIG. 4, taken along line 5—5 of FIG. 4 and illustrating a portion of the catch mechanism thereof in detail.
Figure 6:
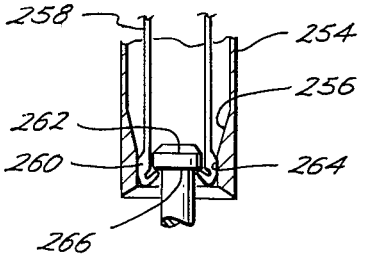
FIG. 6 is a fragmentary sectional view representing the lower portion of an overshop type down hole pulling tool representing a further modified embodiment of the present invention that is adapted for engagement with a standard fishing neck of a down hole object.

Referring now to FIGS. 4–6, there is illustrated a pulling tool mechanism that is in the form of an overshot structure but which functions from the latching, and unlatching standpoint in similar manner as described above in connection with the tool illustrated in FIGS. 1–3. The overshot pulling tool mechanism is illustrated generally at 150 in FIG. 4 and includes an upper sub structure 152 that is formed to define an internally threaded upper portion 154 that may be interconnected with suitable wire line running equipment. The upper sub member 152 is also formed to define an internal passage 156 that is enlarged at the lower portion thereof and defines a receptacle 160 adapted to receive a tubular sleeve element 162 that extends through a guide aperture 164 defined at the lower portion of the upper sub. The lower portion of the upper sub is also externally threaded and is adapted to receive the internally threaded upper portion 166 of an upper housing 168 that cooperates with the internal tube 162 in such manner as to define an annulus or spring chamber 170 adapted to receive a compression spring 172. The compression spring is interposed between abutment surfaces 174 and 176 that are defined respectively by the upper sub member 152 and the upper portion of an inner body structure 178 that is movably disposed within an intermediate latching mandrel portion 180 of the outer body or housing of the tool mechanism 150. The latching mandrel portion 180 of the body structure is provided with an upper externally threaded portion 182 that is adapted for threaded engagement with the lower internally threaded extremity 184 of the housing structure 168. The latching mandrel portion 180 of the housing is also formed to define an externally threaded lower extremity 186 that is adapted for threaded engagement with the upper internally threaded portion 188 of an overshot housing 190 that defines a frusto-conical internal cam surface 192 and an external tapered guide surface 194 that functions to guide objects into the overshot housing or to guide the overshot housing relative to such objects.

The inner body structure 178 is defined by an enlarged upper extremity defining a stop shoulder 196 that is adapted to engage the upper portion of the upper externally threaded extremity of the latching mandrel 182. Thus, the shoulder relationship between the inner body structure 178 and the upper extremity of the latching mandrel prevents further downward movement of the inner body structure relative to the outer housing. As shown in FIG. 4, the inner body structure 178 may move only upwardly relative to the outer housing and such movement is of course against the compression of the spring 172 and causes movement of the guide tube 162 relative to the guide aperture 164. The inner body structure 178 includes a reduced diameter portion 198 having a lower externally threaded extremity 200 that is received in threaded engagement within an internally threaded connector element 202 that defines a shoulder surface 204 capable of supporting the lower extremity of a latching control element 206 that is positioned about the tubular portion 198 of the inner body. The latching control element 206 has an outer configuration that is merely reversed in comparsion to the structure of the latching control mechanism illustrated in FIG. 2.

The connector element 202 is formed to define a lower internally and externally threaded portion 208 that is adapted externally to receive an internally threaded portion of a collet element 210 having a plurality of depending spring fingers 212 that are formed to define tapered external cam surfaces 214 and internal gripping teeth 216. As the collet mechanism is cammed radially inwardly responsive to downward movement of the inner body structure 178, the gripping teeth 216 of the respective collet fingers establish a locked engagement with a fish that has been received within the overshot housing 190.

For the purpose of achieving actuation of the latching control mechanism 206, an adjustable spacer tube 218 is threadedly connected to the lower internally threaded portion 208 of the connector element 202 and is adjustably locked relative thereto by means of a locking element 220. An enlarged abutment element 222 is threadedly secured to the lower extremity of the tube 218 and is positioned to contact the object or fish that is received within the overshot housing. Appropriate adjustment of the tube 218 relative to the connector element 202 will accurately position the lower extremity of the abutment element 222 in order to properly position the grappling teeth 216 of the collet fingers when latching movement occurs.

The latching mandrel 180 is provided with a plurality of guide pin elements such as shown at 224 and 226, having the inner extremities thereof projecting into respective latching recesses 228 and 230 and being maintained in fixed relation with the latching mandrel. The latching control element 206 is formed to define a plurality of recesses, one of which is shown in full line at 230 in FIG. 5. The recess is formed to define upper pin receptacle portions 232 and 234 that are adapted to receive and properly position the guide pin element 226 to achieve latching and unlatching configuration of the collet structure relative to the overshot housing. The recess 230 is also formed to define opposed generally parallel guide surfaces 236 and 238 and lower and upper tapered cam surfaces 240 and 242, respectively. The lower portion of the recess 230 defines a lower pin receptacle 244 that is adapted to receive the guide pin 226 in properly seated engagement therein. A plurality of guide spring elements are provided as shown generally at 246, one being positioned within each of the recesses and reacting with appropriate ones of the guide pins to induce relative rotational control and guidance of the pins as the pins move relative to the inner body structure. Each of the spring elements incorporates an intermediate portion 248 that is interconnected with respect to the latching control element 206 in any suitable manner and includes lower and upper inclined and yieldable extremities 250 and 252.

As the overshot mechanism 150 is moved downwardly into engagement with the fish, abutment element 222 contacts the upper extremity of the fish and further downward movement of the mechanism 150 causes the outer housing structure and the guide pins to move downwardly relative to the respective recesses, thus positioning the guide pins within respective ones of the latching and unlatching receptacles 232 and 234. In the position illustrated in FIG. 5, the pin 226 is moving toward the unlatching receptacle 234 and thus the collet fingers 212 are not cammed inwardly by the cam surface 192 into tightly secured engagement with the fish. In the event such latching movement is desired, the outer housing structure is moved upwardly, causing the force of the fish against the abutment element 222 to be relieved and thus allowing the compression spring 172 to urge the inner body structure 178 downwardly relative to the outer housing and thus, as seen in FIG. 5, causing a relative upward movement of the guide pin 226 as compared to the recess 230. When this occurs, the pin will engage the inclined yieldable portion 250 of the control spring and will cause relative rotational movement of the inner and outer body structures of the overshot mechanism thus causing the pin 226 to be oriented with respect to the latching receptacle 232 or with the inclined cam surface 242. The pin is then caused to move downwardly into engagement with the upper spring portion 252 which causes rotation of the latching control element 206, orienting cam surface 242 or latching receptacle of 232 relative to the pin. Relative upward movement of the pin as compared to the recess will then cause the pin to engage the cam surface and be cammed into the receptacle 232 or to be moved directly into the receptacle 232. Such movement will cause the lower cam surface 192 of the overshot housing to urge the lower extremities of the spring fingers into tight engagement with the fish, thus causing the teeth 216 of the grappling collet structures to establish appropriate gripping relationship with the object to be removed from the well.

In the event subsequent unlatching movement is desired, the inner and outer body structures are controllably shifted in such manner that the guide pin 226 will move downwardly in relation to the recess 230 thus causing the guide pin to engage the upper or lower yieldable portions of the control spring 246. If the upper portion 252 of the controlled spring is engaged, the guide pin will be cammed in such manner as to cause relative rotation of the inner and outer body portions and thus causing the guide pin to move into engagement with the yieldable lower portion 250 of the spring structure. Further downward movement of the pin will yield the lower spring portion and allow the pin to pass whereupon further upward movement will cause camming of the pin into the receptacle 244 by means of the tapered cam surface 240. The inner and outer body structures of the overshot mechanism then may be moved in such manner as to achieve upward movement of the pin relative to the recess 230, thereby causing the pin to be cammed into appropriate guided relationship past the yieldable upper extremity 252 of the spring structure 246 and into received relationship within the unlatching receptacle 234.

In FIG. 6 there is illustrated an overshot housing structure 254 having a tapered internal cam surface 256 that is capable of causing inward camming movement of spring fingers 258, thus positioning lower tool engaging elements 260 into gripping relationship with a standard fishing neck 262. An internal cylindrical surface 264 cooperates with the tool engaging elements 260 to maintain the tool engaging elements in properly interlocked relationship with the shoulder surface 266 of the fishing neck. The overshot mechanism illustrated in FIG. 6 functions in similar manner as the overshot grappling structure of FIGS. 4 and 5 and may be simply substituted for the lower portion of the structure illustrated in FIG. 4.

The latching and unlatching cycles described above in connection with FIGS. 4 and 5 may be repeated indefinitely without any necessity for removing the overshot mechanism from the well bore for resetting operations, etc. The mechanism may be latched and unlatched as many times as is appropriate to accomplish the service operation involved. Moreover, in the event the overshot type pulling tool is undersized for the particular pulling opertion involved, it may be simply unlatched from the fish or from the down hole tool, removed from the well bore and replaced with an overshot mechanism of heavier duty.

The present invention is thus intended for use in accomplishing a wide variety of down hole service operations including installation and removal of down hole tools and fishing operations for stuck or lost tools within the well bore. It is intended that the embodiments disclosed herein not be in any way considered limiting of the spirit and scope of the present invention, it being obvious that other embodiments of the invention may be employed within the teachings of the invention. Having thus described my invention in detail,

I claim:

1. A tool used to retrieve an article in a well bore, comprising:

a first assembly adapted to be connected to apparatus extending down in to the bore, said first assembly including:

a pin extending radially of the bore;

a shoulder for butting against the article to limit movement of said first assembly toward the article; and caged fingers with each finger having an end movable to a position for engaging the article;

a second assembly movably mounted with said first assembly for moving the fingers into the engaging position, said second assembly including:

a body having a cavity with two grooves of unequal length extending axially of the bore, the pin of said first assembly being disposed within the cavity for moving within the grooves;

a spring mounted with the body for moving the pin from alignment with the shorter groove to alignment with the longer groove when said second assembly is moved relative to the first assembly;

an annular shoulder sloping radially of the well bore for moving the ends of the fingers into the engaging position as the pin moves in the longer groove; and means mounted with said first assembly for urging said second assembly axially of the well bore, said urging means moving the annular shoulder of said second assembly toward the caged fingers of said first assembly for moving each end of the fingers radially into the engaging position after the shoulder on said first assembly limits its movement toward the article.

2. The tool of claim 1, wherein:

the butting shoulder of said first assembly is mounted with apparatus for adjusting the axial distance between the butting shoulder and the ends of said fingers in the engaging position.

3. The tool of claim 1, wherein:

the spring of said second assembly includes a leaf spring having an attaching portion extending axially of the bore and a first cantilevered arm sloping away from the attaching portion for directing the pin into alignment with the longer groove as said second assembly moves axially of said first assembly.

4. The tool of claim 3, wherein:

the leaf spring further has a second cantilvered arm sloping away from the attaching portion in a direction opposite to the first cantilevered arm for permitting the pin to bypass said spring and engage a shoulder in the cavity of the body to move the pin into alignment with the shorter groove which thereby moves the ends of said fingers into a disengaging position.

5. The tool of claim 4, wherein:

the free end of the cantilevered arms of the leaf spring are positioned near the side walls of said cavity to prevent the pin from moving past the outboard end of the first arm when moving into alignment with the longer groove and from moving past the outboard end of the second arm when moving into ailgnment with the shorter groove.

6. The tool of claim 1, wherein:

said urging means is a coil spring concentrically disposed around a portion of said second assembly.

7. The tool of claim 6, wherein:

each finger includes an outwardly facing shoulder for engaging an inside surface of the article.

8. The tool of claim 6, wherein:

each finger includes an inwardly facing shoulder for engaging an outside surface of the article.

9. The tool of claim 1, wherein:

the butting shoulder of said first assembly is carried by a sleeve mounted around the caged fingers, said sleeve being threadedly mounted with said first assembly for adjusting the distance between the butting shoulder and the ends of said fingers in the engaging position.

10. The tool of claim 9, wherein:

each finger includes an outwardly facing shoulder for engaging an inside surface of the article.

11. The tool of claim 10, wherein:

the spring of said second assembly includes a leaf spring having an attaching portion extending axially of the bore and a first cantilevered arm sloping away from the attaching portion for directing the pin into alignment with the longer groove as said second assembly moves axially of said first assembly.

12. The tool of claim 11, wherein:

the leaf spring further has a second cantilevered arm sloping away from the attaching portion in a direction opposite to the first cantilevered arm for permitting the pin to bypass said spring and engage a shoulder in the cavity of the body to move the pin into alignment with the shorter groove which thereby moves the ends of said fingers into a disengaging position.

13. The tool of claim 12, wherein:

the free end of the cantilevered arms of the leaf spring are positioned near the side walls of said cavity to prevent the pin from moving past the outboard end of the first arm when moving into alignment with the longer groove and from moving past the outboard end of the second arm when moving into alignment with the shorter groove.

14. The tool of claim 1, wherein:

the butting shoulder of said first assembly is carried by a leg mounted within the caged fingers, said leg being threadedly mounted with said first assembly for adjusting the distance between the butting shoulder and the ends of said fingers in the engaging position.

15. The tool of claim 4, wherein:

each finger includes an inwardly facing shoulder for engaging an outside surface of the article.

16. The tool of claim 15, wherein:

the spring of said second assembly includes a leaf spring having an attaching portion extending axially of the bore and a first cantilevered arm sloping away from the attaching portion for directing the pin into alignment with the longer groove as the second assembly moves axially of said first assembly.

17. The tool of claim 16, wherein:

the leaf spring further has a second cantilevered arm sloping away from the attaching portion in a direction opposite to the first cantilevered arm for permitting the pin to bypass said spring and engage a shoulder in the cavity of the body to move the pin into alignment with the shorter groove which thereby moves the ends of said fingers into a disengaging position.

18. The tool of claim 17, wherein:

the free end of the cantilevered arms of the leaf spring are positioned near the side walls of said cavity to prevent the pin from moving past the outboard end of the first arm when moving into alignment with the longer groove and from moving past the outboard end of the second arm when moving into alignment with the shorter groove.

* * * * *